United States Patent [19]

Storace

[11] Patent Number: 4,864,924

[45] Date of Patent: Sep. 12, 1989

[54] PRINTWHEEL DETENT DISENGAGING APPARATUS

[75] Inventor: Anthony Storace, Norwalk, Conn.

[73] Assignee: Pitney Bowes Inc., Stamford, Conn.

[21] Appl. No.: 136,088

[22] Filed: Dec. 21, 1987

[51] Int. Cl.[4] ..... B41J 1/348

[52] U.S. Cl. ..... 101/110; 101/99; 74/527; 403/DIG. 6

[58] Field of Search ..... 101/91, 99, 110; 74/527; 403/328, DIG. 6

[56] References Cited

U.S. PATENT DOCUMENTS

| | | | |
|---|---|---|---|
| 2,162,359 | 6/1939 | Rhinevault | 403/328 |
| 3,045,498 | 7/1962 | Viezzoli | 74/527 |
| 3,768,333 | 10/1973 | Bidwell | 74/527 |
| 3,932,916 | 1/1976 | Baker | 74/527 |
| 4,149,460 | 4/1979 | Sato | 101/110 |
| 4,244,081 | 1/1981 | Beyer et al. | 403/328 |
| 4,246,643 | 1/1981 | Hubbard | 101/91 |
| 4,271,758 | 6/1981 | Osterhof | 101/91 |

*Primary Examiner*—William Pieprz

*Attorney, Agent, or Firm*—Michael J. DeSha; David E. Pitchenik; Melvin J. Scolnick

[57] ABSTRACT

A printwheel detent disengaging mechanism enables low-torque high-speed automatic printwheel setting. In the engaged position spring-loaded ball in a rotatable shaft bears on a detent ball disposed in a bore in a sleeve surrounding the shaft to cam the detent ball into detent vees of the printwheel. When the shaft is rotated so that the spring-laded ball no longer bears on the detent ball, the detent force is removed and low torque printwheel setting may be accomplished. When setting is completed, the shaft is rotated back into position where the spring-loaded ball bears on the detent ball.

7 Claims, 7 Drawing Sheets

PRINTWHEEL DETENT DISENGAGING APPARATUS

BACKGROUND OF THE INVENTION

The invention relate to printwheel setting apparatus and more particularly to printwheel setting mechanisms for postage meters.

Printwheel setting mechanisms are well known and are described for example in U.S. Pat. No. 4,579,054 issued to Buan, et al. in respect to printwheels for value printing in a flat-bed printer. In addition to the value printing, postage meters typically are required to print a date, and normally allow selection of a slogan for printing on a mailpiece. Some postage metering devices serve as parcel register to provide shipping information for parcel carrier services. These register are typically required to print a parcel identification number (PIN) for each parcel. The number is normally increased in sequence for successive parcels.

Typically, in conventional postage meters the selection of the date and slogan will be done manually. The indexing of the partial identification number then is normally done automatically. Thus, each of the various printing elements are separately mounted and separately actuated by the operator or from the register.

U.S. Pat. No. 4,398,458 discloses a date-setting mechanism for automatically setting a date in response to a keyboard actuation. U.S. Pat. No. 4,649,489 also discusses an aspect of date-setting through the keyboard. U.S. Pat. No. 4,321,867 discloses a PIN number setting device for a drum-type postage meter.

U.S. Pat. No. 3,832,946 to Lupkas discloses a value printing mechanism using a solenoid actuated drive for setting and encoding printwheels.

Conventionally, the dater printwheels of postage meters are set manually. Each has a detent to provide accurate positioning as well as a degree of "float" to help to keep all printwheel members in a common plane. It was found that the torque necessary to overcome the detent makes high speed automatic setting of the printwheels difficult.

It is an object of the invention to provide a setting mechanism for printwheels in which the printwheel detent is in place when the wheel is stationary for providing alignment and "float" and in which the detent is deactivated when it is desired to turn the printwheel.

SUMMARY OF THE INVENTION

In accordance with the invention, the printwheel detenting apparatus comprises a detenting apparatus for a printwheel of the type having a plurality of detent vees on an inner surface thereof, the detenting apparatus comprising a detenting ball, means for positioning the detenting ball for camming into a detent vee of a printwheel, a spring-loaded ball, means for moving said spring-loaded ball into a first position bearing against said detenting ball for camming said detenting ball into a detent vee to provide alignment of the printwheels, and to a second position wherein said spring-loaded ball does not bear against the detenting ball whereby the detenting force is removed from the printwheel.

The invention is particularly suited for date printwheels, PIN wheels, and/or a slogan block in the nonsecure areas of a postage meter.

FIG. *7a* is a section through a printwheel showing a retractable detent arrangement in the engaged position.

FIG. *7b* is the section of *7a* in the disengaged position.

DESCRIPTION OF THE PREFERRED EMBODIMENT

Figure 1:
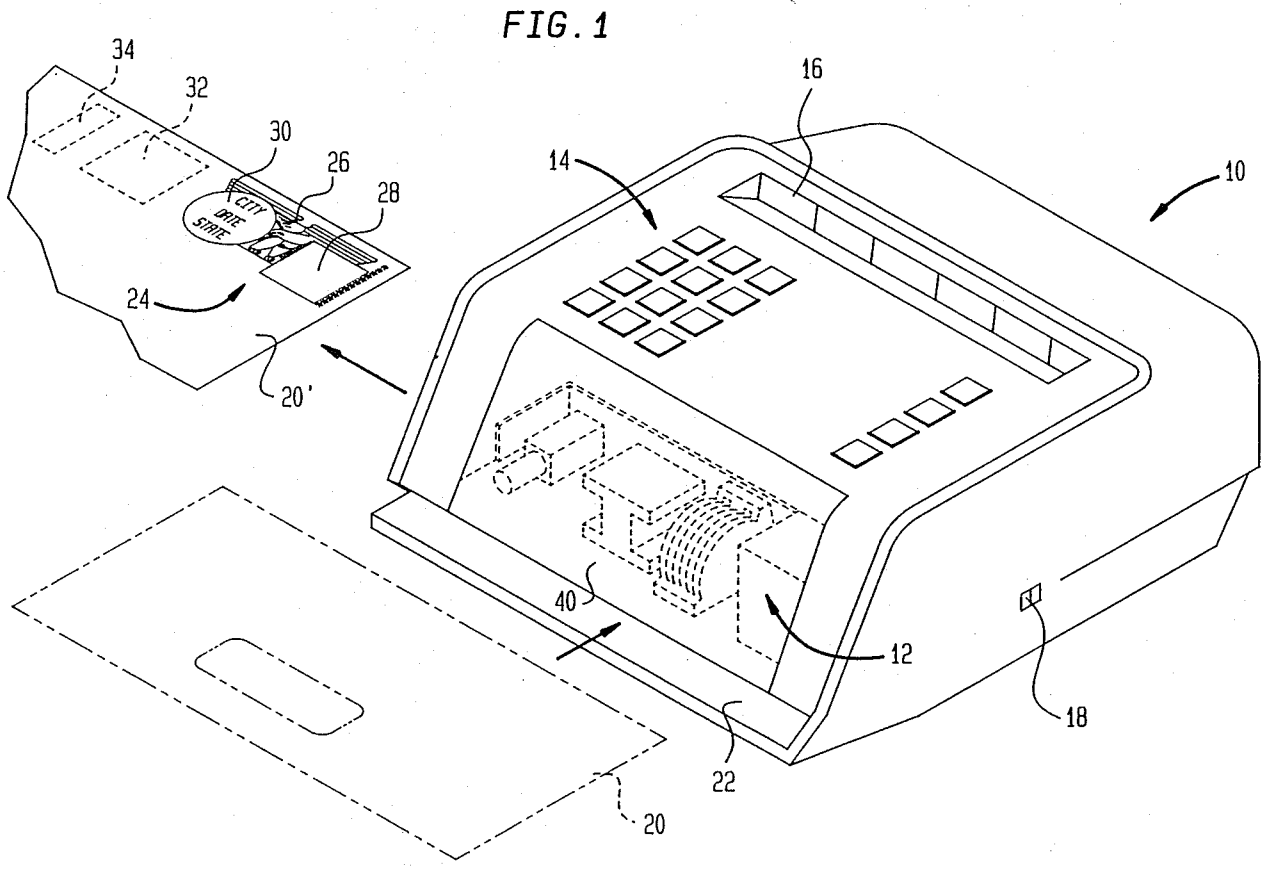
FIG. 1 shows a flat-bed printing postage meter in which the invention may be incorporated.

Referring to FIG. 1 a postage meter 10 in which a setting mechanism in accordance to the invention may be arranged is shown. Meter 10 is of the flat-bed printing type containing printing means to print a postal indicia on a mailpiece, a selection mechanism to select the amount of postage desired to be imprinted, and a register to keep an accurate account of the value of posted imprinted. The printing mechanism 12 is located at the front part of the meter. A keyboard 14 on the top of the meter is used by an operator to control the selection mechanism (not shown) to select the proper value of postage desired to be imprinted. A display window 16 indicates to the operator the value of postage being selected and may also be used to show the amount of postage remaining in the meter and other values as desired. To operate the meter, the operator turns the meter on with on-off switch 18, selects the desired postage value using the keyboard 14, which value is then displayed in the window 16. An envelope 20 to be imprinted with postage is inserted in opening 22 in the lower front portion of the meter. When the envelope is fully inserted, the cycle of the meter is initiated during which time the postal indicia is imprinted on the envelope and the value of the postage imprinted is recorded in the register. Printing is accomplished by reciprocating platen 21 located in the opening 22 opposite the printing surface. The platen rises, presses the envelope against the printing surface, and then retracts. When the printing has been completed, the envelope is ejected from the meter.

The postal indicia 24 is shown and printed on the envelope 20' consists of a number of parts. The main part is a postal design 26 which is approved by the government. Within this design is a value printing area 28 in which the actual amount of postage is printed as described, and a date printing area 30 which, when required by postal regulations is used to imprint the date on which the mailing is taking place. Adjacent to the postal indicia 24 is an area 32 which may be used to imprint an advertising or public service message at the option of the user. Next to the advertising area 32 is an area 34 that may be used, wherever required to imprint information regarding the type of mailing upon which the postal imprint is being made (for example, airmail, book rate, newspaper, and the like).

A further description of this machine may be obtained from U.S. Pat. No. 4,579,054 entitled STAND-ALONE ELECTRONIC MAILING MACHINE specifically incorporated herein by reference.

The setting mechanism in accordance with the invention may also suitably be used in the meter described in application Ser. No. 114,363, filed Oct. 27, 1987 entitled A REMOVABLE POSTAGE METER HAVING AN INDICIA COVER assigned to the assignee of the present invention.

As mentioned previously, in certain parcel register devices and not shown in conjunction with the postage meter of FIG. 1 there may be required a so-called PIN printer. The PIN printer as included herein would comprise a bank of printwheels laterally spaced from the other printwheel banks, perhaps taking the place of the slogan block, for impressing a partial identification number onto a mailpiece. It will be understood that the term mailpiece will also refer to tapes imprinted with information and used on parcels.

Figure 2:
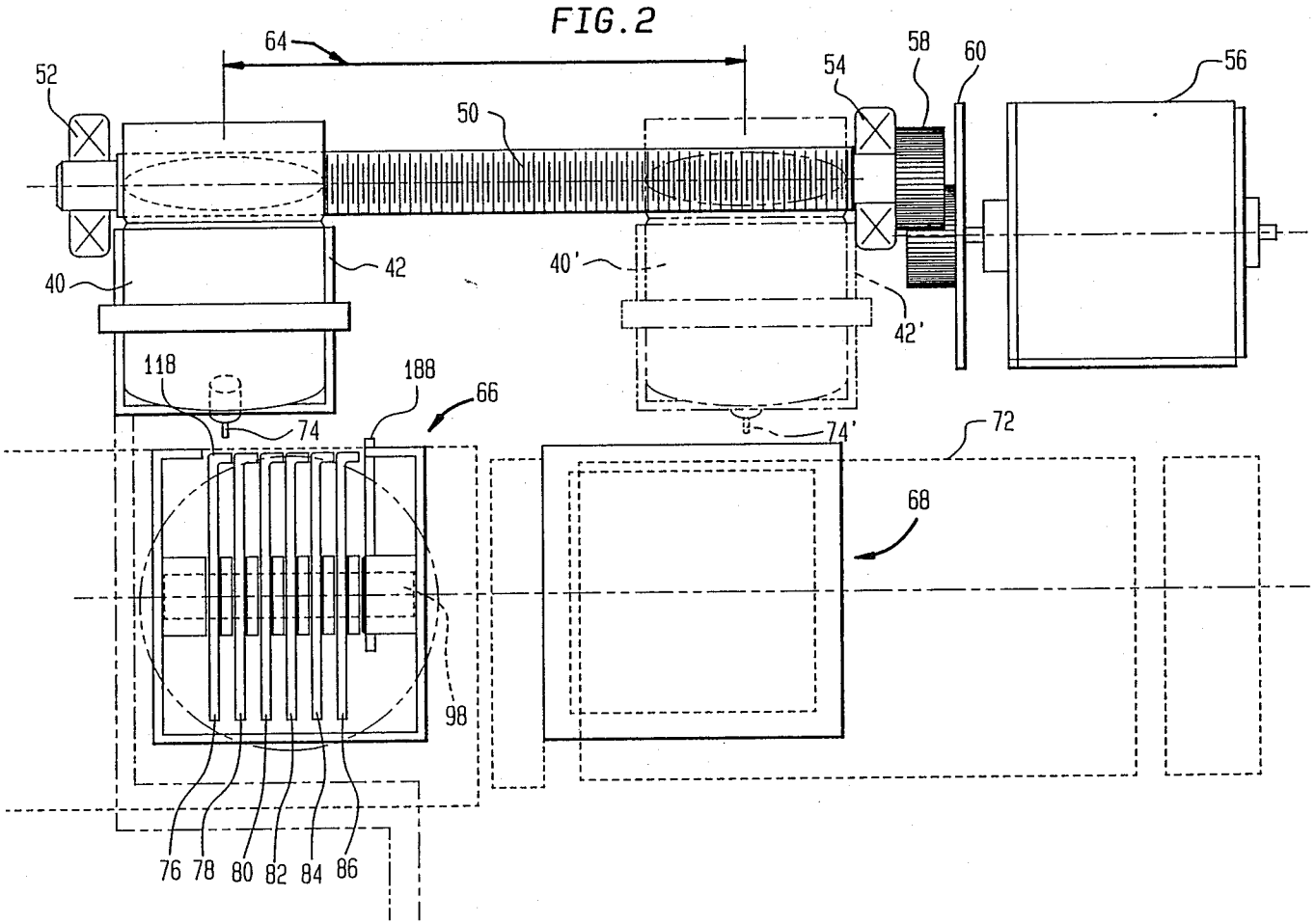
FIG. 2 shows a section viewed from the bottom of a printwheel setting mechanism in accordance with the invention.
Figure 3:
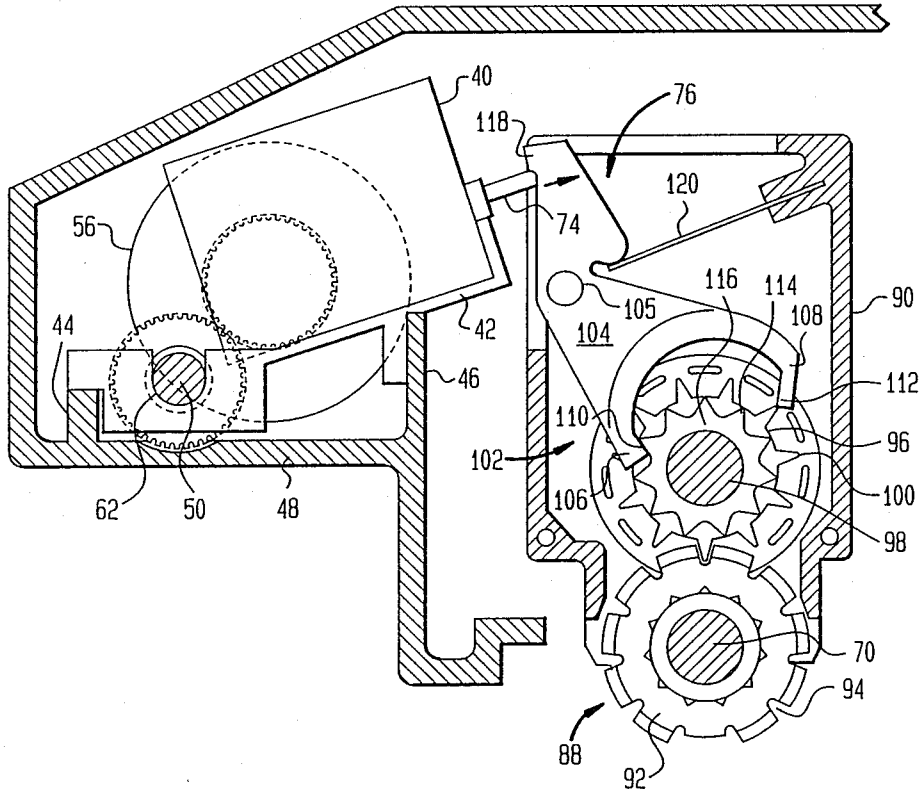
FIG. 3 is a side view along a section of the printwheel setting mechanism.

FIGS. 2 and 3 taken together show an arrangement in accordance with the invention for setting the printwheels of the dater and pin counter as well as for turning the slogan block if desired.

As seen in FIGS. 2 and 3, solenoid 40, suitably solenoid 194C available from Shindengen, is mounted on carriage 42 which slides on rails 44 and 46 projecting upwardly from frame 48. Lead screw 50, suitably journalled on bearings 52 and 54, is rotated by stepper motor 56 through a conventional gearing arrangement indicated at 58. Encoder wheels 60 blocks and unblocks LED-Photodiode detector arrays in conventional manner to monitor the rotation of the lead screw 50. As best seen in FIG. 3, the threads of lead screw 50 engage a threaded partially-open bore 62 in the carriage 42.

The lead screw 50 and threaded bore 62 cooperate to drive the carriage 42 to position the solenoid 40 to any position between the extremes shown at 40 and 40' as indicated by arrow 64. It will be understood that only one carriage and solenoid are slideably mounted on the rails and the primed numerals shown on the second illustrated solenoid refer only to the location of the solenoid and carriage at the opposite extreme of the lead screw. Dater module 66 and PIN module 68 shown in solid lines are juxtaposed to the rail 46 and are arranged such that the printwheel axis in each module shown at 70 in FIG. 3 lies parallel to the lead screw 50. In case of the printwheels for the dater module 66, the printwheels will carry numerals corresponding to the day, month, or year. As seen in FIG. 2, there are six printwheel actuators which would allow numerals for the date of the month, the month, and the last digits of the year.

For the PIN counter printwheels (not shown), each letter or mailpiece requires that the least significant digit be incremented and the adjacent wheels are incremented for tens and hundreds and beyond for large volumes of mail. Typically there would be five printwheels and actuators for the PIN counter 68.

The slogan block indicated in dashed lines at 72 is typically a four-sided block which is rotatable to provide four separate imprints. It will be appreciated that other configurations of printwheel modules may be disposed in similar fashion as desired.

In the location of solenoid 40 as seen in FIG. 2, solenoid pin 74 is positioned to strike the printwheel actuator shown generally at 76. It will be understood that the lead screw 50 may be operated to position the solenoid 40 and therefore pin 74 to strike each of the actuators 76, 78, 80, 82, 84 or 86 as desired and similar printwheel actuators are understood to be included within PIN module 68 and as part of the slogan block 72.

Turning to FIG. 3, the actuating mechanism 76 for the corresponding printwheel 88 is shown. It will be understood from FIG. 2 that there is a similar actuation arrangement for each printwheel. Printwheel 88 is rotatably mounted on shaft 70 which is held in suitable manner (not shown) on module frame 90 of printwheel module 66. The printwheel 88 has a plurality of raised print elements 92 with slots indicated at 94 therebetween spaced about its periphery. Pin wheel 96 rotatably mounted on shaft 98 has teeth or pins 100 on the periphery which engage sequentially with the slots of printwheel 88.

Printwheel 88 is advanced by a verge mechanism indicated generally at 102. The verge mechanism comprises a verge 104 which is mounted for oscillatory motion about a shaft 106. The verge 104 has two arms 106 and 108 having respective projections 110 and 112 thereon which upon oscillation of verge 104 are arranged to alternately engage teeth 114 of starwheel 116. The starwheel 116 is in turn affixed to pin wheel 94 for rotation about shaft 98. The upper part of verge 104 includes a projection 118 which is disposed adjacent pin 74 of the solenoid 40. The verge 104 moves clockwise about shaft 106 whenever power is applied to solenoid 40 and pin 74 strikes projection 118. Return spring 120 is distorted downwardly when verge 104 moves clockwise under the force of solenoid pin 74 to provide a return force on the verge.

Figure 4:
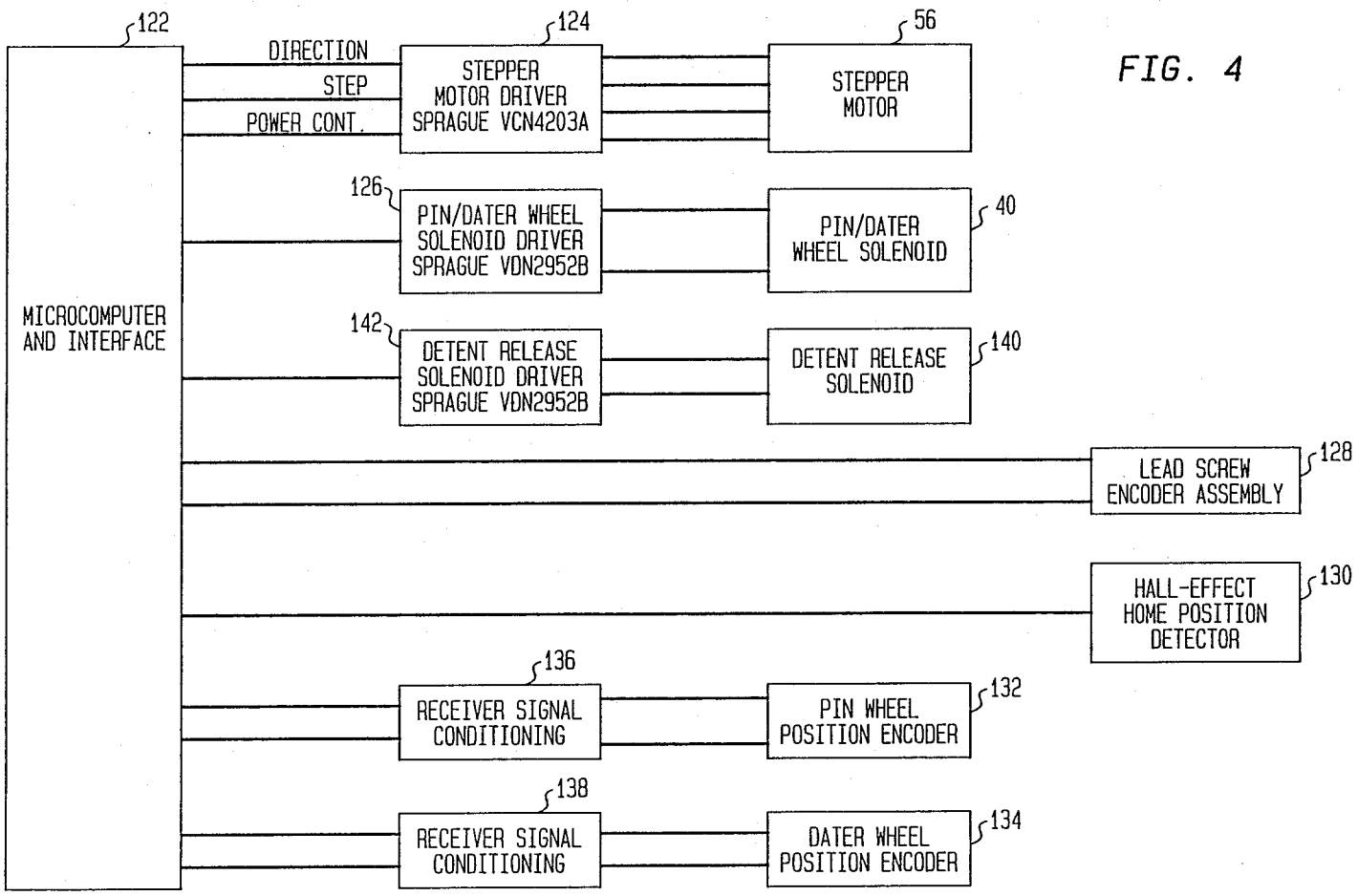
FIG. 4 is a block diagram of the control for the printwheel setting device in accordance with the invention.

FIG. 4 is a block diagram of the control arrangement for the printwheel setting mechanism. Computer 122 provides direction, step, and power control information to stepping motor driver 124, suitably No. VCN4203A available from Sprague, connected to stepper motor 56 to properly position the solenoid carriage 42. Solenoid 40 is connected to a solenoid driver 126, suitably VDN2952B from Sprague connected to computer 122. Preferably, the output of lead screw encoder 128 and home position detector 130 are provided to computer 122, The home position detector is a Hall-effect device used in conjunction with a magnet (not shown) positioned on carriage 42 to detect the home position of the carriage and to allow relative encoding thereafter. Pin wheel encoder 132 and dater wheel position encoder 134 are connected through respective signal conditioning devices 136 and 138 to computer 122. The computer 122 provides signals to actuate a detent release solenoid 140, whose function will be described below in connection with FIGS. *7a* and *7b*, through solenoid driver 142, suitably VDN2952B.

Figure 5:
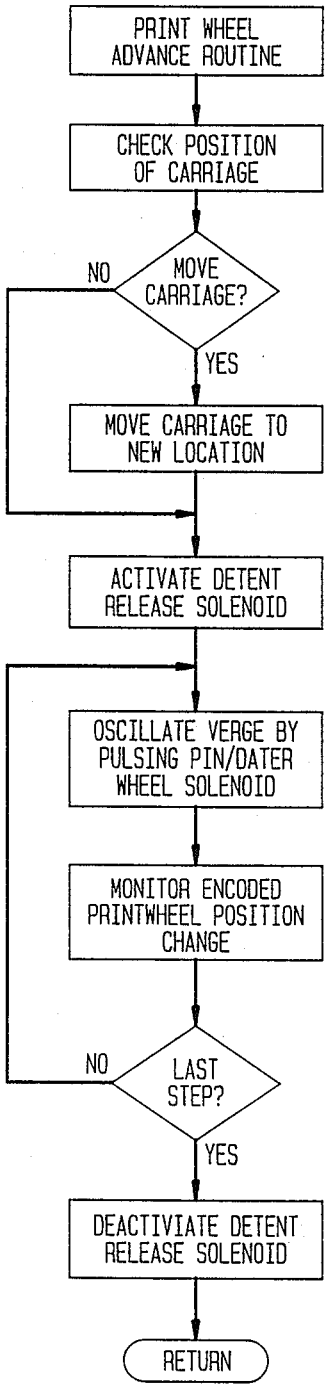
FIG. 5 is a flow chat illustrating a printwheel setting routine.

The operation of the printwheel setting device in accordance with the invention will now be described. FIG. 5 is a flow chart of the printwheel setting mechanism. Under control of the computer 122 and with relative encoding from the encoder assembly, motor 56 turns lead screw 50 to position solenoid pin 74 opposite the projections (e.g. 118) of the actuation mechanism of the desired printwheel, again for example printwheel 88 of the dater module 66.

It will be appreciated by those skilled in the art that the solenoid 40 carried by the carriage 42 is free to travel back and forth along the lead screw 50 because it is physically separated from the wheel setting mechanism. The separation facilitates assembly and eliminates problems in prior art mechanisms which require gears to move in and out of mesh.

The solenoid 40 is pulsed for each desired advance of the printwheel. The pin 74 strikes projection 118 to rotate verge 104 and thereby drive projection 112 against a tooth of starwheel 116. Arm 106 moves out of the way of the teeth on the starwheel as the verge 104 rotates clockwise. The starwheel 116 advances and moves the crown of the next tooth to the point where as the verge 104, under the influence of return spring 120, returns to its home position when the power to the solenoid 40 is removed, projection 110 engages the tooth and rotating upwards completes the advance of the starwheel 116. The verge 104 thus oscillates back and forth through a small angle driven both by the advance of the solenoid pin 74 and the return force due to the spring 120.

Preferably, the verge 104 and the geometry of starwheel 116 is selected to advance the starwheel approximately fifty percent (50%) of its pitch in either direction. It will be appreciated, however, that the mechanism of this embodiment rotates the starwheel 116 only in one direction. As the starwheel 116 turns, the pin wheel 94 which is fixed to it, turns the printwheel 88.

It will be appreciated that only one pitch of the starwheel 116 is required to turn the printwheel 88 to a new printing position. For the four-sided slogan block in module 72, multiple pitches will be required to turn it through the quarter turn to achieve its new position.

Figure 6:
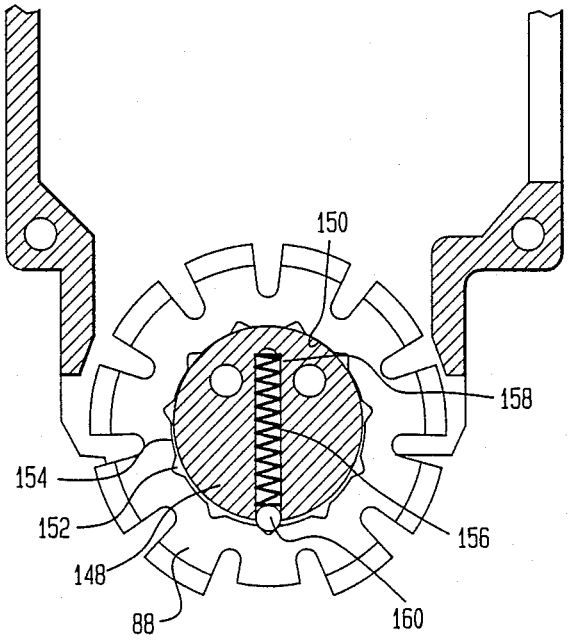
FIG. 6 (PRIOR ART)
FIG. 6 is a section through a printwheel showing a conventional fixed detent arrangement in the prior art.
Figure 7A:
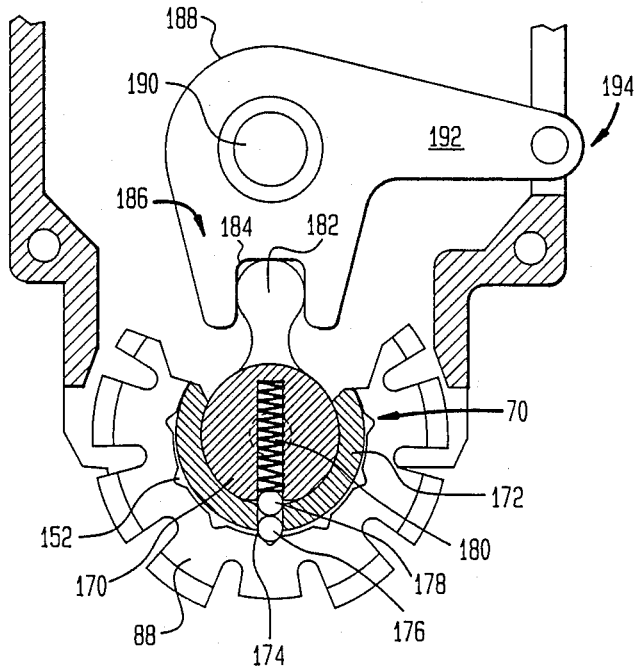
Figure 7B:
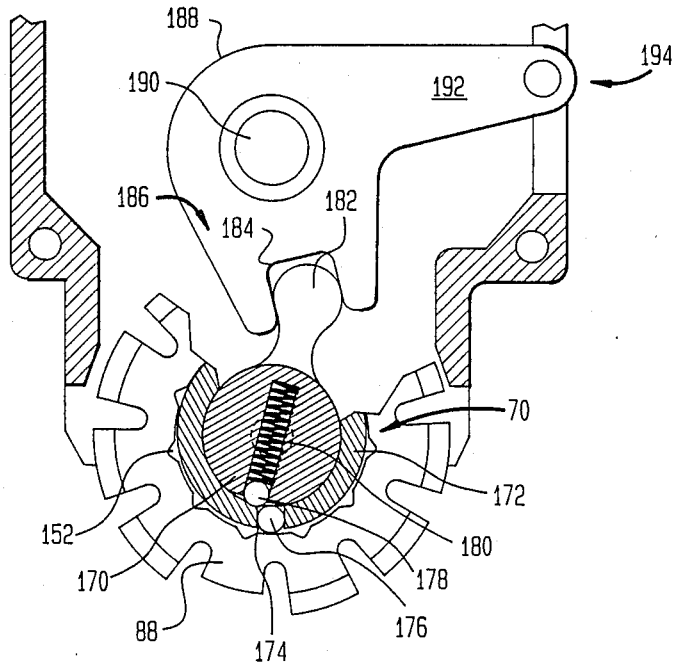

FIG. 6 is a section through a printwheel showing a detent arrangement of conventional design disposed within the shaft. Printwheel 88, shown herein again as representative of each of the printwheels in modules 66 and 68 of FIG. 2, is mounted on shaft 148. The inner circumference 150 of printwheel 88 is formed into a plurality of detent cam vees, one of which is indicated at 152, each associated with a respective printing element of the printwheel. The detent vees are separated by flats, one of which is indicated at 154.

Spring 156 arranged in bore 158 spring loads ball 160 which rides on the inner circumference 150. This detent arrangement provides accurate positioning and a spring-loaded float which helps in keeping all printwheel numbers in a common plane While this detent works well and may be used in conjunction with the apparatus illustrated and described in connection with FIGS. 2 and 3, it has been found that the torque required to overcome the detent force makes high-speed automatic setting difficult.

More specifically, as seen in FIG. 6, in turning the printwheel 88, ball 160 is cammed out of one vee into the adjacent vee. The spring 156 in camming the ball 160 into the vee exerts a torque on the printwheel 88 forcing it into proper alignment.

The spring 156 forcing the ball 160 into the vee also causes the inner circumference 150 to be pressed against the shaft 148 on the opposite side from the ball 160. This contact is one source of detent torque which must be overcome in order to turn the printwheel. The larger torque requirement arises because of the force necessary to cam the ball 160 out of the vee.

FIGS. *7a* and *7b* illustrate apparatus for reducing the detent torque while printwheel 88 is turning. FIG. *7a* shows the detent mechanism in the engaged position In accordance with the invention, the shaft 70 also seen in FIG. 3 comprises an inner shaft 170 rotatably received within sleeve 172. Sleeve 172 has an aperture or bore 174 therethrough in which ball 176 is captured. In the engaged position illustrated, ball 176 is cammed into the detent vees 152 by ball 178 which is spring-loaded by spring 180.

Lug or finger 182 extending from inner shaft 170 is captured in slot 184 in arm 186 of crank 188 seen also in FIG. 2. Crank 188 is pivotally mounted on shaft 190 and arm 192 is connected at 194 to an actuator, suitably detent release solenoid 140 (not shown in this FIG.) for oscillating the crank 188 from the position illustrated in FIG. *7a* to that shown in FIG. *7b*.

When the solenoid is actuated to enable printwheel setting, the arm 192 is pulled upward so that crank 188 rotates in the counter-clockwise direction about shaft 190. Lug 182 in turn is moved rightward to cause inner shaft 170 to rotate. Ball 178 rolls off ball 176 and along the inner surface of sleeve 172. Thus the spring force no longer bears on ball 176 and the detenting force is eliminated. The printwheel 88 may thus be turned very easily with low torque and at high speed as described in connection with FIG. 3.

Where the solenoid is deactuated, crank 188 returns to its original position and shaft 170 is rotated back to its original position with ball 178 pressing against ball 176 to again provide the detenting force to properly align printwheel 88.

This application incorporates certain material common to another application identified as Ser. No. 136,087 filed Dec. 21, 1987 entitled AUTOMATIC PRINTWHEEL SETTING SYSTEM.

What is claimed is:

1. A detenting apparatus for a printwheel of the type having a plurality of detent vees on an inner surface thereof, the detenting apparatus comprising:

a detenting ball;

means for positioning the detenting ball for camming into a detent vee of a printwheel;

a spring-loaded ball;

means for moving said spring-loaded ball into a first position bearing against said detenting ball for camming said detenting ball into a detent vee to provide alignment of the printwheels and to a second position wherein said spring-loaded ball does not bear against the detenting ball whereby the detenting force is removed from the printwheel.

2. The printwheel of claim 1 wherein said means for positioning the detenting ball is a sleeve with an aperture therein, said detenting ball being disposed in the aperture, and wherein said means for positioning is a shaft having said spring-loaded ball disposed in a bore thereof, said shaft being rotatable in said sleeve to position said spring-loaded ball to bear against said detenting ball.

3. The printwheel of claim 2 further comprising crank means connected to said shaft for selectively rotating the shaft.

4. In a detent apparatus for a printwheel of the type wherein the printwheel includes an inner surface having a plurality of detent vees, said printwheel being rotatably mounted on a shaft having a spring-loaded ball in a bore therein for camming into said detent vees for providing a detenting force on said printwheel, the improvement comprising, apparatus for selectively removing the detenting force, the apparatus including a sleeve having a bore therein for holding a detenting ball therein positioned for engagement with the vees of the printwheels and said shaft having said spring-loaded ball therein is movable to a first position wherein said spring-loaded ball bears upon said detenting ball for camming said detenting ball into said detent vees for providing detenting force on said printwheel and to a second position wherein said spring-loaded ball does not bear upon said detenting ball whereby in said second position the detenting force is removed from said printwheel.

5. The detent apparatus of claim 4 further comprising means connected to said shaft for rotating said shaft from one position to the other.

6. The detent apparatus of claim 5 wherein the means for rotating is a crank having a slot therein which captures a finger extending from the shaft.

7. A detent apparatus for a printwheel comprising:

a cylindrical sleeve having an aperture therein;

a first ball disposed in said aperture;

a printwheel rotatably mounts said sleeve, said printwheel having an inner surface which includes a plurality of detent vees;

said first ball being positionable for camming into any of said detent vees for providing a detent force for aligning said printwheel;

a shaft rotatably received within said sleeve;

said shaft including a bore bearing a second ball disposed thereon spring disposed within said bore for spring-loading said second ball.

said shaft being rotatable to a first position wherein said second ball bears upon said first ball to spring load said first ball for camming said first ball into the detent vee force of said printwheel;

said shaft being rotatable to a second position wherein said second ball does not bear upon said first ball whereby said detenting force is removed; and a crank connected to said shaft for rotating said shaft between said first and second positions.

* * * * *